United States Patent [19]

Makohl

[11] Patent Number: 4,485,880

[45] Date of Patent: Dec. 4, 1984

[54] DIRECT DRIVE FOR DEEP-WELL DRILLING

[75] Inventor: Friedhelm Makohl, Hermansburg, Fed. Rep. of Germany

[73] Assignee: Norton Christensen, Inc., Salt Lake City, Utah

[21] Appl. No.: 519,296

[22] Filed: Aug. 1, 1983

[30] Foreign Application Priority Data

Sep. 14, 1982 [DE] Fed. Rep. of Germany ..... 3233980

[51] Int. Cl.[3] ..... F03B 13/02; E21B 4/02

[52] U.S. Cl. ..... 175/107; 418/48; 403/355

[58] Field of Search ..... 175/101, 107; 403/327, 403/355, 356; 418/48, 69

[56] References Cited

U.S. PATENT DOCUMENTS 2,167,019 7/1939 Yost ..... 255/4

2,795,398 6/1957 Ragland ..... 255/28

FOREIGN PATENT DOCUMENTS 2917331 11/1980 Fed. Rep. of Germany .

2332412 7/1975 France ..... 175/107

115626 9/1980 Japan ..... 403/327

*Primary Examiner*—James A. Leppink

*Assistant Examiner*—Michael Starinsky

[57] ABSTRACT

A direct drive for deep-well drill bits on the Moineau displacement principle is provided with locking means detents (10, 11) which are disposed downstream of the working chambers (4) of rotor (3) and stator (2). Actuation of the locking means is effected by coupling throw-in members (13) introduced through the flushing passage from above. Passage through the working chambers and into the locking means detents groove (16, 20, 21) is rendered possible for the throw-in members on relative rotation of rotor and stator.

9 Claims, 3 Drawing Figures

DIRECT DRIVE FOR DEEP-WELL DRILLING

TECHNICAL FIELD

The invention relates to a direct drive for deep-well drilling bits on the Moineau displacement principle.

BACKGROUND ART

In the deep-well drilling art, direct drives are used to deflect the direction of drilling but also for the further drilling of bores which are already inclined. If, in the course of this, the drilling bit jams in the formation for any reason, so firmly that it cannot be released by the torque of the direct drive, then the torque necessary for the release can only be introduced through the rotary table of the derrick and the drill pipe. Since the drill pipe is rotatable in relation to the drilling bit, however, because of the direct drive, a mechanical locking must first be brought about between the drill pipe and the drilling bit before the torque introduced from above can act on the drilling bit.

In a known direct drive of this type (German Patent DE 2,917,331), this is effected by a detent sleeve which is connected to the drive shaft and one which is connected to the bearing housing, which sleeves come into locking engagement through an axial movement exerted on the drilling string. In order that this locking engagement may not occur accidentally through the axial movements occurring in the normal drilling operation, a safety device is present which only releases and frees the axial movement when a certain threshold value is exceeded. The determination of this threshold value is very difficult because if this is set so high that accidental release is reliably avoided, a desired release operation may fail on the other hand, for example because a large proportion of the axial force introduced from above is lost through friction between drill pipe and borehole wall and only a reduced force reaches the safety device.

Furthermore, turbine direct drives are in use in which the locking engagement between the detent sleeves at the stator and rotor side is brought about by a member thrown into the flushing passage from above and entering between the detent sleeves. Here, the detent sleeves are disposed in front of the upstream parts of the turbine. With this arrangement, an adequate stability of the whole of the rotor parts with regard to the torque which can be applied from the rotary table in the locking state is necessary, because these torques are conveyed from the detent sleeves through the rotor parts to the drilling bit.

Although the last mentioned version of a direct drive with locking device renders possible a reliable locking at the desired moment and excludes accidental locking, the use on a direct drive on the Moineau drive principle is not easily possible. On application of a high torque from the rotary table, the rotor would travel radially outwards inside the stator because of the elastomer construction of the one part and would cancel the frictional or positive connection between the detent sleeves brought about by the member thrown in. In addition, the eccentric movements of the rotor inside the stator and the rotation of the rotor, counter to this movement, about its own axis counteract jamming of the thrown-in member between the detent sleeves and hence the occurrence of the locking.

It is an object of the present invention to obviate or mitigate this problem.

SUMMARY OF THE INVENTION

The present invention is a direct drive for a deep-well drilling bit with a helically coiled rotor and stator and chambers formed in between on the Moineau displacement principle, with a drive shaft which can be connected on the one hand to the rotor of the direct drive and on the other hand to the deep-well drilling bit and an outer tube which surrounds this shaft coaxially and can be connected to the stator of the direct drive and with a locking device which, on its actuation, locks the drive shaft to the outer tube and which is formed by a detent means which comprises a first detent means or sleeve associated with the drive shaft means and a second detent means or sleeve associated with the outer tube, and in which the locking device or means can be actuated by means of a throw-in member which can be inserted as a coupling element or key between the detent sleeves and at most has a diameter which amounts to the width of the chambers formed between the rotor and the stator of the direct drive, the throw-in member being able to be taken axially through the direct drive to the detent sleeves on relative rotation of rotor and stator.

The detent means of the locking device or means is locked by a member thrown into the flushing passge. In order to be able to transmit the torque occurring in the locking state and to eliminate the influences of the eccentric rotor movement and counter rotation, the detent is disposed downstream of the motor section in the region of the drive shaft. The thrown-in member is dimensioned according to the chambers formed between the Moineau rotor and stator so that it can pass these chambers in a helical path on relative rotation of rotor and stator in the same direction as in normal drilling operation.

In contrast to the widespread view that a detent disposed downstream of rotor and stator of the direct drive cannot be reached by a throw-in member, the invention starts from the knowledge that the chambers formed between Moineau rotor and stator and in which the flushing liquid develops the driving forces, travel downstream in uniform shape. A member present in one of these chambers can therefore pass the region of rotor and stator. If the rotor is jammed, the relative movement between rotor and stator necessary for this travel can be brought about by turning the stator by means of the drill pipe in the opposite direction of rotation to the normal rotor rotation.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT(s)

Figure 1:
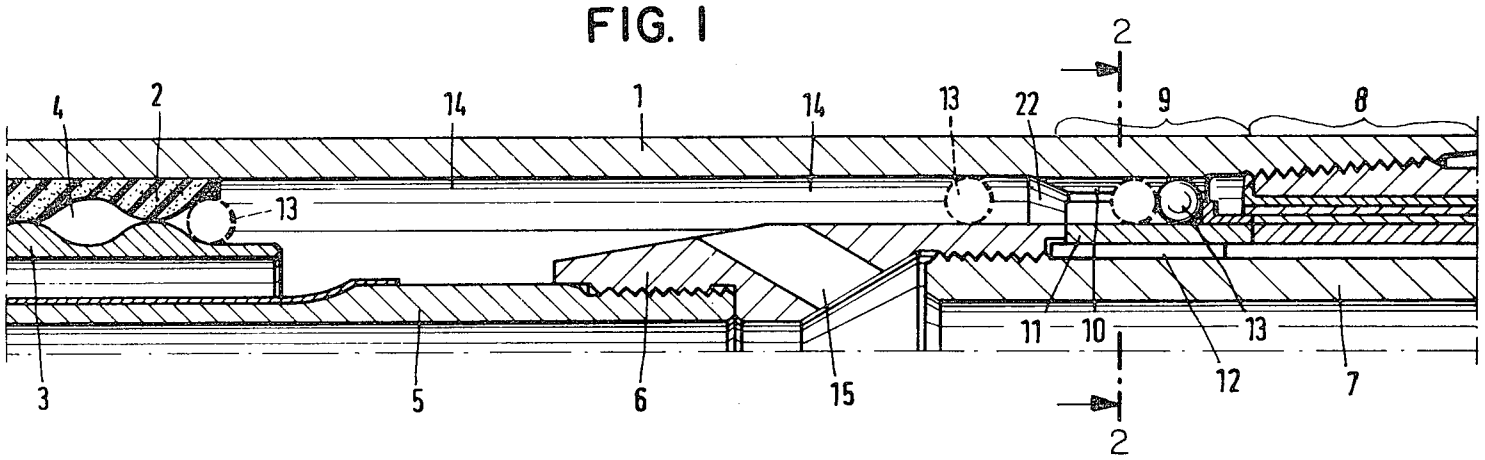
FIG. 1 is a partial longitudinal section through a part of the direct drive with the locking device according to the invention.

The illustration in FIG. 1 is restricted to the region of a direct drive essential for an explanation of the invention. Disposed inside an outer tube 1 is a stator 2 which receives a rotor 3. Between them, rotor 3 and stator 2 define chambers 4 in which the flushing liquid pumped through the direct drive exerts driving forces on the rotor 3. The rotor 3 is connected, at its upstream end, to a flexible shaft 5 which leads through a hollow interior of the rotor, converts the eccentric movement of the rotor into a concentric one and transmits this via a coupling shaft 6 to a hollow drive shaft 7. The drive shaft 7 leads through a bearing section and carries a drill bit at the lower end. Above the bearing section, of which only a radial bearing means 8 situated upstream is illustrated here, there is a detent means 9 consisting of a first detent means or sleeve 10 at the stator side and a second detent means or sleeve 11 at the rotor side. The detent sleeve 10 at the stator side is here formed integrally with the outer tube 1, while the detent sleeve 11 at the rotor side is located on the drive shaft 7 being held against relative rotation by a fitting key 12 and is located axially between a bush of the radial bearing 8 and the coupling shaft 6,. A spherical throw-in member 13, the path of which is illustrated in three stages from one of the working chambers 4 through an annular chamber 14 surrounding the coupling shaft into the detent 9, brings about the locking when necessary. The opening 15 shown present in the coupling shaft 6 is one of the passages for the flushing liquid which, after passing the motor section, flows further through the hollow interior of the drive shaft 7 to the drill bit. The width of the openings 15 is narrower than the throw-in member 13 so that it cannot enter or go astray.

Figure 2B:
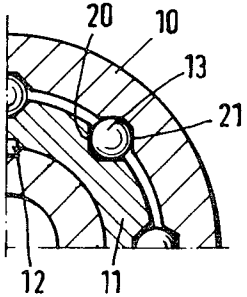
FIG. 2*a* and FIG. 2*b* are partial cross-sectional views of two alternative embodiments of the detent means taken on line A–B of FIG. 1 extending through the locking device.
Figure 2A:
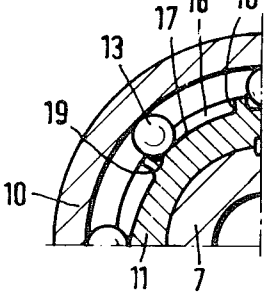

FIG. 2*a* and FIG. 2*b* show alternative embodiments of the detent sleeves as partial cross-sections through the detent means 9. FIG. 2*a* to the left represents a frictional detent means in which sleeve 11 at the rotor side has one or more longitudinal grooves or recesses 16 of which the bottoms 17 of the grooves rise steadily radially outwardly from one circumferentially spaced boundary wall 18 of maximum radial depth to the other 19 of minimum radial depth. The sleeve 10 at the stator side is ungrooved. A throw-in member 13 which enters such a groove is urged outwards by the rising bottom 17 of the groove on relative rotation of the detent sleeve 11 at the rotor side, until it is clamped between the bottom 17 of the groove and the detent sleeve 10 at the stator side. In this state, the detent means is locked.

FIG. 2*b* to the right, represents a positive detent in which both the detent sleeve 11 at the rotor side and detent sleeve 10 at the stator side have longitudinal grooves 20, 21 which can receive the throw-in member 13 in the mutually aligned position. As a result of the throw-in member, a positive torque coupling results between the sleeves 10, 11. The region 22 of the grooves, situated upstream, may preferably be made funnel-shaped to facilitate the penetration of the shaped body.

In order to actuate the locking device in the event of a jammed drill bit, a throw-in member is first thrown into the flushing passage of the drill pipe at the top and its descent is awaited. Then the drill pipe is slowly turned, namely in the opposite direction of rotation to the normal direction of rotation of the direct drive. In the course of this the throw-in member travels through the region of rotor and stator in a helical path inside a chamber formed between rotor and stator until, after leaving the chamber, it falls onto the detent. By further rotation, the grooves of the detent sleeves are brought cyclically into a position in which it is possible for the throw-in member to penetrate as a result of the action of the force of gravity. As a rule, only one throw-in member is needed for the locking because when this has coupled the deten sleeves, further throw-in members can no longer pass the region of rotor and stator.

I claim:

1. A direct drive for a deep-well drilling bit comprising:

a motor section including helically coiled rotor, stator and chambers of predetermined width formed in between the rotor and stator and operable on the Moineau displacement principle, drive shaft means connecting the rotor to the deep-well drilling bit, an outer tube coaxially surrounding the drive shaft means and connected to the stator, and locking means for coupling and locking the drive shaft means to the outer tube downstream of the motor section including first detent means on the drive shaft including an axis of rotation, second detent means on the outer tube, and a throw-in member which can be inserted from above the motor section, must pass through one of the chambers, and received between and couple the detent means together and having a diameter which at most amounts to the width of the chambers formed between the rotor and stator and can pass axially through a chamber to the detent means on relative rotation of rotor and stator.

2. A direct drive according to claim 1 wherein the throw-in member is spherical.

3. A direct drive according to claim 1 wherein the detent means are adapted for frictional locking engagement with and by the throw-in member.

4. A direct drive according to claim 3 wherein the detent means comprises:

at least one recess at an outer generated surface of the first detent means including a bottom of varying radial distance from the axis of rotation of the first detent means that increases tangentially from a position of maximum depth and elsewhere is smaller than the diameter of the throw-in member.

5. A direct drive according to claim 4 wherein the recess is a longitudinal receiving groove extending axially of and circumferentially about the first detent means from the position of maximum radial depth to a minimum radial depth.

6. A direct drive according to claim 1 wherein the detent means are adapted for positive locking engagement with and by the throw-in member.

7. A direct drive according to claim 6 wherein each of the first and second detent means comprises:

at least one longitudinal groove extending axially in each of their adjacent generated surfaces and each groove taken individually having a radial depth that is less than the diameter of the throw-in member but when the grooves are taken together and aligned radially the radial depths of the aligned grooves provide a receiving gap, between the detent means, of greater radial width than the diameter of the throw-in member and which is adapted to receive and positively lockingly engage the throw-in member therebetween with the detent means.

8. A direct drive according to claim 5 wherein the receiving groove has a funnel-shaped entrance portion for the throw-in member.

9. A direct drive according to claim 7 wherein the receiving gap has a funnel-shape entrance portion for the throw-in member.

* * * * *